US010752023B2

(12) United States Patent
De Roeck

(10) Patent No.: US 10,752,023 B2
(45) Date of Patent: Aug. 25, 2020

(54) VACUUM-BELT FOR AN INKJET PRINTING DEVICE

(71) Applicant: AGFA NV, Mortsel (BE)

(72) Inventor: Luc De Roeck, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 16/314,691

(22) PCT Filed: Jun. 15, 2017

(86) PCT No.: PCT/EP2017/064678
§ 371 (c)(1),
(2) Date: Jan. 2, 2019

(87) PCT Pub. No.: WO2018/007121
PCT Pub. Date: Jan. 11, 2018

(65) Prior Publication Data

US 2019/0240997 A1 Aug. 8, 2019

(30) Foreign Application Priority Data

Jul. 6, 2016 (EP) ..... 16178123

(51) Int. Cl.
*B41J 11/00* (2006.01)
*B41J 13/00* (2006.01)

(52) U.S. Cl.
CPC ..... *B41J 11/007* (2013.01); *B41J 11/001* (2013.01); *B41J 11/0085* (2013.01); *B41J 13/0063* (2013.01)

(58) Field of Classification Search
CPC ..... B41J 11/007; B41J 11/001; B41J 11/0085; B41J 13/0063
See application file for complete search history.

(56) References Cited

U.S. PATENT DOCUMENTS 6,425,580 B1 * 7/2002 Yaneda ..... B41J 11/007 271/132
8,292,420 B2 10/2012 Weingartner et al.
2003/0038420 A1 2/2003 Cleary et al.

FOREIGN PATENT DOCUMENTS

EP 3 017 957 A1 5/2016
GB 2 381 242 A 4/2003

OTHER PUBLICATIONS

Official Communication issued in International Patent Application No. PCT/EP2017/064678, dated Sep. 5, 2017.

* cited by examiner

*Primary Examiner* — Justin Seo
(74) *Attorney, Agent, or Firm* — Stinson LLP

(57) ABSTRACT

An inkjet printing device includes a vacuum-belt and vacuum-table including a flat area positioned between a first and second air-groove aligned along a conveying direction. The vacuum-belt includes a first column of vacuum-belt-air-channels connected to the first air-groove a second column of vacuum-belt-air-channels connected to the second air-groove, and a third column of vacuum-belt-air-channels connected to the flat area by a plurality of air channels formed by a rough layer at the back-side of the vacuum-belt and/or a rough layer on the flat area.

19 Claims, 3 Drawing Sheets

VACUUM-BELT FOR AN INKJET PRINTING DEVICE

CROSS REFERENCE TO RELATED APPLICATIONS

This application is a 371 National Stage Application of PCT/EP2017/064678, filed Jun. 15, 2017. This application claims the benefit of European Application No. 16178123.2, filed Jul. 6, 2016, which is incorporated by reference herein in its entirety.

BACKGROUND OF THE INVENTION

1. Field of the Invention

The present invention relates to an inkjet printing device which comprises a vacuum-belt to hold down and stable a print-receiver while conveying and printing, especially in an industrial environment.

2. Description of the Related Art

Inkjet printing devices with a vacuum-belt to transport a print-receiver underneath a printhead are well-known. Such inkjet printing devices currently are adapted for sign & display market with small sized print-receivers to much larger print-receivers for industrial market or multiple print-receivers which are printed at the same time. Also these inkjet printing devices are adapted for special print-receivers such as in manufacturing methods for glass, laminate floorings, carpets, textiles comprising an inkjet printing method. For example DIEFFENBACHER™ Colorizer is capable for furniture production with formats up to 2070 mm×3600 mm.

The special print-receivers have sometimes to be handled very carefully on a vacuum-belt, because it is for example brittle; breakable; crumbly or frail or heat-sensitive.

To print on such large print-receivers or multiple print-receivers; printed at the same time; large vacuum-belts to transport such print-receivers are a big challenge. The coupling of these print-receivers on the vacuum-belt has to remain whole the time until the print-receiver is printed. The power, needed for this coupling by air-sucking, has to be very strong which may deform or break the print-receiver before, while printing and/or after printing, for example visibility of imprintings of the vacuum-belt-air-channels from the vacuum-belt in the print-receiver at the back-side of the print-receiver and sometimes also on the front-side, which is the print side; of the print-receiver.

But even with a very strong vacuum power for coupling by air-sucking some specific print-receivers, such as corrugated fibreboard, textile, leather; plastic foil, thermosetting resin impregnated paper substrate may decoupled by curling, crumpling and/or crinkling of the print-receiver while printing and/or curing the inkjet ink on the print-receiver.

This is in the current inkjet printing devices solved by adding guiders or extra hold-downing means to prevent the decoupling of the print-receiver (300) while printing such as disclosed in U.S. Pat. No. 8,292,420 (DURST) but such guiders have to calibrate in height for each print-receiver which delays the production times.

Therefore, there remains a need for an inkjet printing device which can handle specific print-receivers and/or large-sized print-receivers while exhibiting high reliability for industrial inkjet printing.

SUMMARY OF THE INVENTION

In order to overcome the problems described above, preferred embodiments of the present invention have been realised with an inkjet printing device as defined below. An inkjet printing method using the inkjet printing device is also defined below.

In a nutshell the present invention is an inkjet printing device (100) comprising a vacuum-belt (400) and vacuum-table (500) which comprises a flat area (550) which is positioned between to a first and second air-groove (530) aligned along the conveying direction wherein the vacuum-belt (400) comprises:

- a first column of vacuum-belt-air-channels (418) connected to the first air-groove (530); and
- a second column of air connected to the second air-groove (530); and
- a third column of air connected to the flat area (550) by a plurality of air channels formed by a rough layer (420) at the back-side of the vacuum-belt (400) and/or a rough layer (520) on the flat area (550).

Further advantages and preferred embodiments of the present invention will become apparent from the following description.

DETAILED DESCRIPTION OF THE PREFERRED EMBODIMENTS

Figure 1:
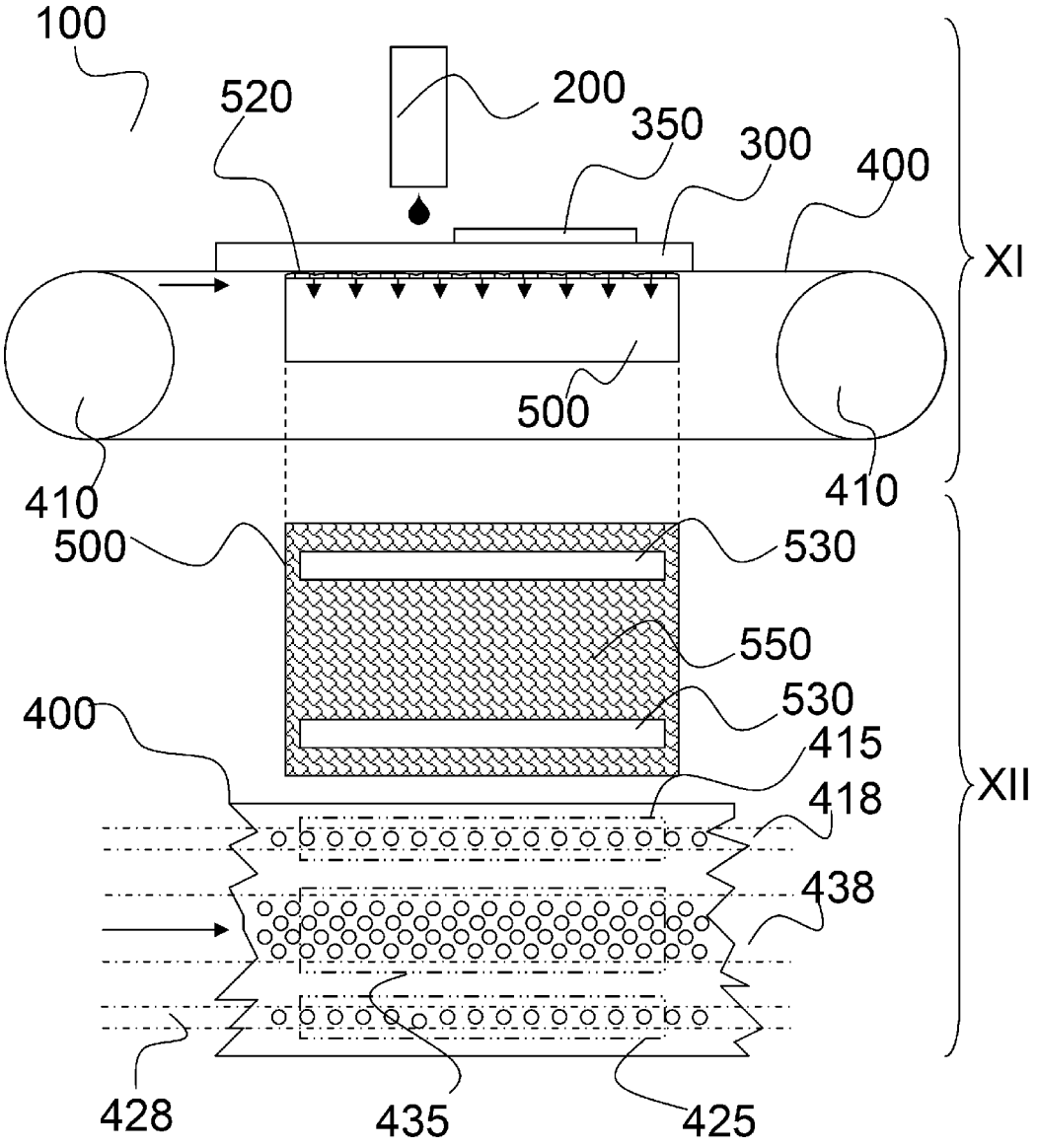
FIG. 1 (FIG. 1) shows cross-sections (XI, XII) from a preferred embodiment of the present invention.

FIG. 1 (FIG. 1) shows cross-sections (XI, XII) from a preferred embodiment of the present invention. Cross-section XI is a section in the XZ-plane and cross-section XII is a section in the XY-plane, also called a top-view section from the preferred inkjet printing device (100) which is not illustrated. The XY-plane is parallel to the ground (not visible) whereon the inkjet printing device (100) is placed. The inkjet printing device (100) comprises a vacuum-belt (400) (400) wrapped around a pair of pulleys (410) and a vacuum-table (500). A print-receiver (300) (300) is hold down by air-suction (vertical arrows) and conveyed in a conveying direction (horizontal arrow). A printhead (200) drops ink to mark the print-receiver (300) with a pattern (350).

The vacuum-table (500) comprises two air-grooves (530) and a flat area (550) between these two air-grooves (530). The vacuum-table (500) comprises at the support array a rough layer (520).

A first row of vacuum-belt-air-channels (418) is connected to one of the air-grooves (530), a second row of vacuum-belt-air-channels (428) is connected to the other air-groove (530). The third row of vacuum-belt-air-channels (438) is connected to the flat area (550). Each row of vacuum-belt-air-channels (418, 428, and 438) creates a vacuum-zone (415, 425, and 435).

Figure 2:
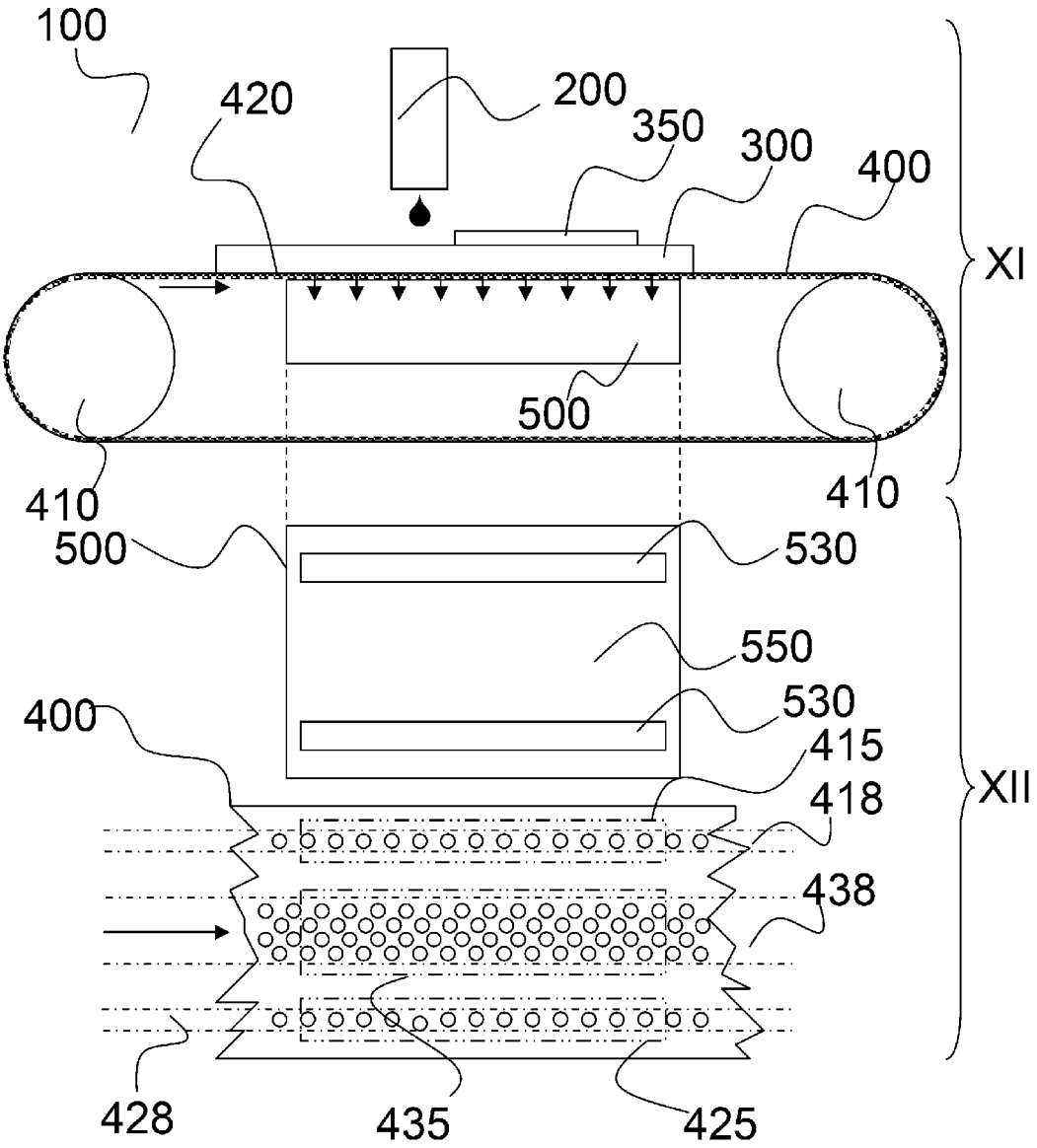
FIG. 2 (FIG. 2) shows a similar embodiment as in FIG. 1 (FIG. 1) but wherein a rough layer (420) is attached at the back-side of the vacuum-belt (400) (400) instead of the vacuum-table (500).

FIG. 2 (FIG. 2) shows a similar embodiment as in FIG. 1 (FIG. 1) but wherein a rough layer (420) is attached at the back-side of the vacuum-belt (400) (400) instead of the vacuum-table (500).

Figure 3:
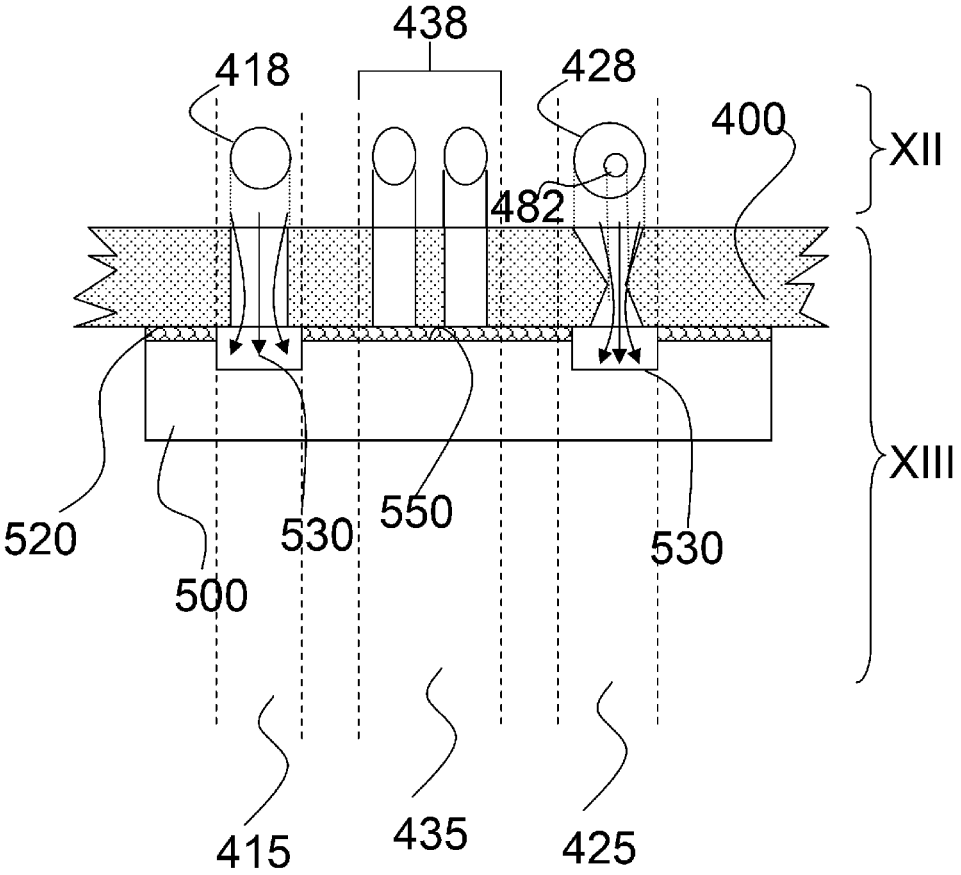
FIG. 3 (FIG. 3) shows cross-sections (XII, XIII) from a preferred embodiment of the present invention.

FIG. 3 (FIG. 3) shows cross-sections (XII, XIII) from a preferred embodiment of the present invention. Cross-section XII is a section in the XY-plane, also called a top-view section and cross-section XII is a section in the YZ-plane. The vacuum-belt (400) comprises a first column of vacuum-belt-air-channels (418) is connected to an air-groove (530) in the vacuum-table (500) to create a first vacuum-zone (415); a second column of vacuum-belt-air-channels (428) is connected to another air-groove (530) in the vacuum-table (500) to create a second vacuum-zone (425) but wherein the internal vacuum-belt-air-channel has an internal narrowing which defines the size of the minimal profile area (482).

The vacuum-table (500) has on its support-side a rough layer (520) which is connected with the third column of vacuum-belt-air-channels (438) to generate a third vacuum-zone (435).

The present invention is an inkjet printing device (100) comprising a vacuum-belt (400) wrapped around a vacuum-table (500) along a conveying direction and wherein the vacuum-table (500) comprises a flat area (550) on a support area from the vacuum-table (500) which is positioned between:

- a first air-groove (530) in the support area which is aligned along the conveying direction; and
- a second air-groove (530) in the support area which is aligned along the conveying direction; and wherein the vacuum-belt (400) comprises:

- a first column of vacuum-belt-air-channels (418), along the conveying direction, in the vacuum-belt (400) which are connected to the first air-groove (530); and
- a second column of vacuum-belt-air-channels (418), along the conveying direction, in the vacuum-belt (400) which are connected to the second air-groove (530); and
- a third column of vacuum-belt-air-channels (418), along the conveying direction, in the vacuum-belt (400) which are connected to the flat area (550) by a plurality of (microscopic) air channels formed by a rough layer (420) at the back-side of the vacuum-belt (400) and/or rough layer (520) on the flat area (550).

Preferably is the rough layer only at the back-side of the vacuum-belt (400) because abrading large vacuum-tables (500) (>2 $m^2$) with a determined roughness and flatness below 500 μm is difficult to manufacture or the vacuum-tables (500) should have a support area which is an engineering plastic composition or comprises polyethylene terephthalate (PET), polyamide (PA), high-density polyethylene (HDPE), polytetrafluoroethylene (PTFE), polyoxymethylene (POM) and/or Polyaryletherketone (PAEK) which can be abraded to a lower flatness below 400 μm. This flatness of the support area is of a big importance to have good print quality with the inkjet printing device (100).

The inkjet printing device (100) may comprise multiple air-grooves (530) and multiple first/second/third columns of vacuum-belt-air-channels (418, 428,438).

Each of these columns (first, second third column) of vacuum-belt-air-channels (418, 428, 438) comprises a plurality of vacuum-belt-air-channels along the conveying direction to form a 'column' parallel to this conveying direction the first air-groove (530) and the second air-groove (530) so the created vacuum-zone (415, 425) on this column is elongate shaped and preferably substantially rectangular shaped. The longest side is the length of the vacuum-zone and the shortest side is the width of the vacuum-zone which is defined by the width of the column. Across such a column; such as perpendicular to the conveying direction; also one or more than one vacuum-belt-air-channels may be comprised. The vacuum-belt-air-channels in such a column which are creating a vacuum-zone (415, 425, 435) may be clustered to form substantially a rectangular shape.

The first column and second column of vacuum-belt-air-channels (428) from the present invention are known in the state-of-the-art. The positions of the vacuum-belt-air-channels are in both columns preferably similar to provide equal sized vacuum-zones (415, 425) on the vacuum-belt. But a third column (438) between these two columns seems a bit ambivalent but due to the rough layer (420) at the back-side of the vacuum-belt (400) and/or the rough layer (520) on the flat area (550), it is found that the present invention can handle print-receivers (300) which are difficult to hold down on the vacuum-belt. The positions of the vacuum-belt-air-channels in the third column are preferably arranged in a lattice pattern to have similar vacuum power on all positions in the vacuum-zone (435) created through these vacuum-belt-air-channels (438). The positions may also be arranged in a pseudo-random pattern with blue-noise characteristic, also called blue-noise-pseudo-random pattern, to have equal vacuum power on all positions in the vacuum-zone created through these vacuum-belt-air-channels. The lattice pattern maybe a pattern with rhombic lattice, rectangular lattice, square lattice, hexagonal lattice, parallelogram lattice, equilateral triangular lattice or a honeycomb lattice.

Analogue the positions of the vacuum-belt-air-channels in the first and second column from the present invention are preferably arranged in a lattice pattern to have equal vacuum power on all positions in the vacuum-zone created through these vacuum-belt-air-channels. The positions may also be arranged in a pseudo-random pattern with blue-noise characteristic, also called blue-noise-pseudo-random pattern, to have equal vacuum power on all positions in the vacuum-zone created through these vacuum-belt-air-channels. The lattice pattern maybe a pattern with rhombic lattice, rectangular lattice, square lattice, hexagonal lattice, parallelogram lattice, equilateral triangular lattice or a honeycomb lattice.

Crease-sensitive print-receiver; brittle print-receiver; heat-sensitive print-receiver; edge-curl sensitive print-receiver and rough back-side print-receiver are difficult to be hold down as known in the state-of-the-art in such inkjet printing devices but with the present invention is this overcome, even if these print-receivers has a fold or a ruff so these print-receivers don't have to be flattened and/or ironed first which is an economically benefit due to faster handling and thus printing.

The present invention discloses also an inkjet printing method wherein a print-receiver (300) is conveyed on a vacuum-belt (400) for transporting underneath a printhead (200) from an inkjet printing device (100) according the previous embodiments of the inkjet printing device (100) from the present invention. The print-receiver (300) is attached to the vacuum-belt (400) by air-suction through the vacuum-belt-air-channels in the vacuum-belt (400) namely the first, second and third column of vacuum-belt-air-channels (438) from the present invention. Even the third column of vacuum-belt-air-channels (438) is not connected to an air-groove (530) but to the flat area (550), is the print-receiver (300) attached to the vacuum-belt (400) via the third column of vacuum-belt-air-channels (438) by the micro air-channels; substantially parallel to the plane of the vacuum belt and vacuum table; caused by the roughness on the back-side of the vacuum-belt (400) and/or roughness on the support-side of the vacuum-table (500) which are connected to the first air-groove (530) and/or second air-groove (530).

The print-receiver (300) is preferably selected from the group of crease-sensitive print-receiver; heat-sensitive print-receiver; brittle print-receiver; edge-curl sensitive print-receiver and rough back-side print-receiver because these print-receivers are very hard to handle and to hold down on the vacuum-belt (400) for example styrene sheets, also called styrene boards and corrugated cardboard. In the state-of-the-art inkjet printing devices solutions may be provided for each type of print-receiver mounting another type of vacuum-belt for example with more suction holes. The present invention may handle any kind of print-receivers selected from this group. These print-receivers are preferably flat sheets but maybe also web (roll-to-roll configuration or roll-to-sheet configuration).

Crease-sensitive print-receivers are print-receivers grouped together which easily crease, wrinkle, crumple and/or rumple when handled in a printing device which affects badly the print quality of the marked pattern (350) on the print-receiver (300). Examples of such crease-sensitive print-receivers: flexible films with a thickness below 100 micrometers, preferably below 50 micrometers or flexible sheets with a thickness below 100 micrometers, preferably below 50 micrometers, dye sublimation transfer paper, transfer foil, shrink foil, stretch wrap, plastic wrap, cling wrap, food wrap aluminium foil wax paper. The crinkling while conveying and/or marking these print-receivers and/or drying the pattern (350) marked on these print-receivers becomes less in this present invention because of the third column of vacuum-belt-air-channels.

Brittle print-receivers are print-receivers grouped together which are brittle splintery, crackable and/or easily breakable. The stress-factor while conveying and/or marking these print-receivers and/or drying (curing) the pattern (350) marked on these print-receivers becomes less in this present invention because of the third column of vacuum-belt-air-channels.

Heat-sensitive print-receivers lose their structural integrity above a temperature 35° C., more preferred above 60° C. The loss of structural integrity of a heat-sensitive substrate in a more preferred embodiment is between 35° C. and 300° C., most preferably between 40° C. and 90° C.

Edge-curl-sensitive print-receivers are print-receivers grouped together which are sensitive to curl one or more of their edges. A good example of such edge-curl-sensitive print-receivers is hide leather wherein the tensions internally are different due to the natural product. At the edges the hide leather is mostly also thin which cause easy curling at this edges. By the third column of vacuum-belt-air-channels (438) it is found that also these print-receivers can be hold down while conveying, marking and drying (curing) an jetted ink layer.

Rough back-side print-receivers are print-receivers grouped together which have a rough back-side. Due to this roughness the sucking of such print-receivers on a vacuum conveyor belt is very difficult to handle. By the third column of vacuum-belt-air-channels (438) it is found that also these print-receivers can be hold down while conveying, marking and drying (curing) an jetted ink layer. An example of such print-receiver (300) is natural leather.

In a preferred embodiment the rough layer of the present invention has an average roughness $R_a$ larger than 15 μm, preferably larger than 17 μm and most preferably larger than 20 μm. The average roughness Ra, also called surface roughness, is preferably smaller than 500 μm, more preferably smaller than 400 μm and most preferably smaller than 350 μm. The surface roughness may not too high else the friction between back-side vacuum-belt (400) and vacuum-table (500) while conveying becomes too high which may abrade, wear or fray the vacuum-belt. It is found that the surface roughness (Ra) below 15 μm doesn't meet an effective result for holding all kind of print-receivers, such as the difficult print-receivers as corrugated cardboard and styrene sheets. This may be solved by a stronger vacuum pumps but this compromises the conveying of the vacuum-belt (400) over the vacuum-table (500). A stronger vacuum pump has also an impact on a higher cost of the inkjet printing device (100). Thus the present invention is also an economically benefit because less strong vacuum pumps are needed to convey the vacuum-belt (400) and to hold down print-receivers, especially print-receivers selected from the group crease-sensitive print-receiver; heat-sensitive print-receiver; brittle print-receiver; edge-curl sensitive print-receiver and rough back-side print-receiver.

$R_a$ is the arithmetic average of the absolute values of the roughness profile ordinates. Also known as Arithmetic Average (AA), Center Line Average (CLA). The average roughness is the area between the roughness profile and its mean line, or the integral of the absolute value of the roughness profile height over the evaluation length.

In a preferred embodiment the inkjet printing device (100) of the present invention, a support-side of the vacuum-belt (400) comprises:

- a first vacuum-zone (415) connected to the first column of vacuum-belt-air-channels; and
- a second vacuum-zone (425) connected to the second column of vacuum-belt-air-channels; and
- a third vacuum-zone (435) connected to the third column of vacuum-belt-air-channels; and
- a first non-vacuum-zone between the first vacuum-zone (415) and third vacuum-zone; and
- a second non-vacuum-zone between the second vacuum-zone (425) and the third vacuum-zone;
- and wherein the width from the first non-vacuum-zone is larger than the half of the width from the first vacuum-zone (415) and larger than the half of the width from the air first groove; and wherein the width from the second non-vacuum-zone is larger than the half of the width from the second vacuum-zone (425) and larger than the half of the width from the second air-groove (530).

The width of the first non-vacuum-zone may be larger than the width from the first vacuum-zone (415) and the width of the second non-vacuum-zone may be larger than the width from the second vacuum-zone (425).

The distances between the air-grooves (530) across the conveying direction (=width) is preferably between 5 mm and 50 mm, more preferably between 10 mm and 35 mm. These small distances are of importance to handle elongated print-receivers (300) conveyed in their length on the vacuum-belt (400).

The vacuum-belt (400) may slightly move lateral over its pulleys, to prevent that the third column of vacuum-belt-air-channels (438) becomes connected directly to the first or second air-groove (530) when this column is conveying over these grooves. It is found that the previous embodiment is advantageous. If the third column of vacuum-belt-air-channels (438) becomes connected the air suction on the vacuum-belt (400) becomes lower or a bigger vacuum pump is needed. Therefore the width of the third column of vacuum-belt-air-channels (438) from the present invention is preferably determined so that while conveying the vacuum-belt (400) the third column of vacuum-belt-air-channels (438) doesn't pass the first and second air-groove (530) from the vacuum-table (500).

In a preferred embodiment is the total sum of the minimum-profile-area from the vacuum-belt-air-channels forming the third vacuum-zone (435) is minimum 5 times greater than the total sum of the minimum-profile-area from the vacuum-belt-air-channels forming the first vacuum-zone; and wherein the total sum of the minimum-profile-area from the vacuum-belt-air-channels forming the third vacuum-zone (435) is minimum 5 times greater than the total sum of the minimum-profile-area from the vacuum-belt-air-channels forming the second vacuum-zone.

The air suction power on a vacuum-zone from a vacuum-belt (400) is defined by the vacuum-belt-air-channels, especially by the area of the vacuum-belt-air-channels. The smallest area of a section in a vacuum-belt-air-channel is defined as the minimum-profile-area from the vacuum-belt-air-channel. The section, sometimes called profile, is taken by a plane parallel to the top surface of the vacuum-belt. It is this smallest area which determines the air suction power on the vacuum-zone at the vacuum-belt-air-channel (see also FIG. 3).

It is found that the total sum of the minimum-profile-area from the vacuum-belt-air-channels forming the third vacuum-zone (435) is preferably between 5 and 40 times greater than the total sum of the minimum-profile-area from the vacuum-belt-air-channels from the first vacuum-zone (415), more preferably between 7 and 35 times greater, most preferably between 9 and 30 times greater. Analogue it is found that the total sum of the minimum-profile-area from the vacuum-belt-air-channels forming the third vacuum-zone (435) is preferably between 5 and 40 times greater than the total sum of the minimum-profile-area from the vacuum-belt-air-channels from the second vacuum-zone, (425) more preferably between 7 and 35 times greater, most preferably between 9 and 30 times greater.

In a preferred embodiment is the rough layer (420) at the back-side of the vacuum-belt (400) wherein the rough layer (420) is selected from the group comprising woven fabric and knitted fabric. The knitted fabric is preferably selected from the group comprising weft-knitted fabric and warp-knitted fabric, more preferably the knitted fabric is warp-knitted fabric. The support-side (top-side, cover) of the vacuum-belt (400) comprises preferably a thermoplastic polymer resin coated on the rough layer. The support area of the present invention is preferably abraded engineering plastic composition or comprises polyethylene terephthalate (PET), polyamide (PA), high-density polyethylene (HDPE), polytetrafluoroethylene (PTFE), polyoxymethylene (POM) and/or Polyaryletherketone (PAEK).

The woven fabric is preferably selected from the group comprising plain-weave fabric, twill-weave fabric and satin weave fabric, more preferably woven fabric is a plain-weave fabric.

Woven fabrics are made up of a weft—the yarn going across the width of the fabric—and a warp—the yarn going down the length of the loom. The side of the fabric where the wefts are double-backed to form a non-fraying edge is called the selvedge. Plain-weave fabric the warp and weft are aligned so that they form a simple criss-cross pattern. Plain-weave is strong and hardwearing. In twill-weave fabric the crossings of weft and warp are offset to give a diagonal pattern on the fabric surface. It's strong, drapes well. In satin-weave fabric there is a complex arrangement of warp and weft threads, which allows longer float threads either across the warp or the weft. The long floats mean the light falling on the yarn doesn't scatter and break up, like on a plain-weave fabric. Weft-knitted fabric is made by looping together long lengths of yarn. It can be made by hand or machine. The yarn runs in rows across the fabric. If a stitch is dropped it will ladder down the length of the fabric. In warp-knitted fabric the loops interlock vertically along the length of the fabric. Warp knits are slightly stretchy and do not ladder.

In a preferred embodiment is the rough layer (420) at the back-side of the vacuum-belt (400) impregnated by polyurethane, more preferably thermoplastic polyurethane (TPU) due to its high wear resistance properties. TPU has also the advantage to be non-porous and chemically inert material, superior cut resistance, tear resistance and abrasion resistance. For the same reasons is in a preferred embodiment the vacuum-belt (400) a coated woven fabric or coated knitted fabric which is coated by thermoplastic polyurethane.

In a preferred embodiment a print-receiver (300) is hold down on the vacuum-belt (400) and wherein the print-receiver (300) is preferably selected from the group comprising heat-sensitive print-receiver, such as styrene sheet and rigid multilayered print-receiver (300), such as corrugated fibreboard.

The specific dimensions of vacuum-belt-air-channels in the present invention, will of course, be selected to match the particular vacuum system and the desired vacuum print-receiver (300) holding force needed, depending on the coefficient of friction between the belt and documents, the maximum print-receiver (300) drag forces anticipated in the system, etc.

The dimensions are also determined to minimize the imprints of the vacuum-belt-air-channels in the print-receiver (300).

Inkjet Printing Device (100)

An inkjet printing device (100), such as an inkjet printer, is a marking device that is using a printhead (200) or a printhead (200) assembly with one or more printheads, which jets a liquid, as droplets or vaporized liquid, on a print-receiver. A pattern (350) that is marked by jetting of the inkjet printing device (100) on a print-receiver (300) is preferably an image. The pattern (350) may be achromatic or chromatic colour.

A preferred embodiment of the inkjet printing device (100) is that the inkjet printing device (100) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing. Wide format printers generally use a roll of print-receiver (300) rather than individual sheets of print-receiver (300) but today also wide format printers exist with a printing table whereon print-receiver (300) is loaded. A wide-format printer preferably comprises a belt step conveyor system.

The inkjet printing device (100) may perform a single pass printing method. In a single pass printing method the (inkjet) printheads usually remain stationary and the print-receiver (300) is transported once under the one or more (inkjet) printheads. In a single pass printing method the method may be performed by using page wide (inkjet) printheads or multiple staggered (inkjet) printheads which cover the entire width of the print-receiver. An example of a single pass printing method is disclosed in EP2633998 (AGFA GRAPHICS NV). Such inkjet printing device (100) is also a called a single pass inkjet printing device (100).

The inkjet printing device (100) may mark a broad range of print-receivers such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, plastic foils, transparency foils, adhesive PVC sheets, impregnated paper, PVC plates, Styrene plates and others. A print-receiver (300) may comprise an inkjet acceptance layer. A print-receiver (300) may be a paper substrate or an impregnated paper substrate or a thermosetting resin impregnated paper substrate.

Preferably the inkjet printing device (100) comprises one or more printheads (200) jetting UV curable ink to mark print-receiver (300) and a UV source (=Ultra Violet source), as dryer system, to cure the inks and/or pattern (350) after marking. Spreading of a UV curable inkjet ink on a print-receiver (300) may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a print-receiver (300) in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing device (100) may comprise an IR source (=Infra Red source) to solidify the ink by infrared radiation. The IR source is preferably a NIR source (=Near Infra Red source) such as a NIR lamp. The IR source may comprise carbon infrared emitters which has a very short response time.

The IR source or UV source in the above preferred embodiments create a curing zone on the vacuum-belt (400) to immobilize jetted ink on the print-receiver.

The inkjet printing device (100) may comprise corona discharge equipment to treating the print-receiver (300) before the print-receiver (300) passes a printhead (200) of the inkjet printing device (100) because some print-receivers have chemically inert and/or nonporous top-surfaces leading to a low surface energy which may result in bad print quality.

The embodiment of the printing method is preferably performed by an industrial inkjet printing device (100) such as a corrugated fibreboard inkjet printing device or leather inkjet printing device.

The embodiment of the printing method is preferably comprised in an industrial inkjet printing method such as a corrugated fibreboard inkjet printing method or leather inkjet printing method.

Computer-to-Plate System

The inkjet printing device (100) of the embodiment may be used to create printing plates used for computer-to-plate (CTP) systems in which a proprietary liquid is jetted onto a metal base to create an imaged plate from the digital record. So the printing method of the embodiment is preferably comprised in an inkjet computer-to-plate manufacturing method. These plates require no processing or post-baking and can be used immediately after the ink-jet imaging is complete. Another advantage is that platesetters with an inkjet printing device (100) is less expensive than laser or thermal equipment normally used in computer-to-plate (CTP) systems. Preferably the object that may be jetted by the embodiment of the inkjet printing device (100) is a lithographic printing plate. An example of such a lithographic printing plate manufactured by an inkjet printing device (100) is disclosed EP1179422 B (AGFA GRAPHICS NV).

The handling of printing plates on a vacuum-belt (400) is difficult due to uncontrolled adhering of this print-receiver (300) against the vacuum-belt. Heat on the print-receiver (300) may cause a curvature effect on the print-receiver (300) which cannot be hold down on current vacuum-belts so the print-receiver (300) may crash against a printhead (200) from the inkjet printing device (100). If no extra guiding means are implemented in the inkjet printing device (100) to hold down the printing plate which introduces an extra manufacturing cost. For example in a hot printing area and/or hot curing area, if available, the adhering of such printing plates against the vacuum-belt (400) is less. But in the present invention the connection, the hold-down and flat-down, of the print-receiver (300) with the vacuum-belt (400) is guaranteed even in these hot printing area and/or curing area, if available, from the inkjet printing device (100).

Leather Inkjet Printing Device

Preferably the inkjet printing device (100) is a leather inkjet printing device, performing a leather inkjet printing method more preferably a natural leather inkjet printing method. The handling of such print-receivers on a vacuum-belt (400) is difficult due to uncontrolled adhering of the print-receiver (300) against the vacuum-belt (400) due to easy crinkle of the print-receiver (300) while transporting and/or heat upon the surface of the leather (e.g. natural leather), for example in a hot print zone and/or hot curing zone. his crinkle effect on the print-receiver (300) cannot be hold down and hold flat on current vacuum-belts so the print-receiver (300) may touch against a printhead (200) from the inkjet printing device (100). Also crinkled leather is not acceptable for sale for example by bad print quality if the leather was not flat while printed. If no extra guiding means are implemented in the inkjet printing device (100) to hold down and flat the leather which introduces an extra manufacturing cost. For example in a hot printing area and/or hot curing area, if available, the crinkle effect of the leather can be become bigger. But in the present invention the connection, the hold-down and flat-down, of the print-receiver (300) with the vacuum-belt (400) is guaranteed even in these hot printing area and/or curing area, if available, from the inkjet printing device (100). The leather is preferably pre-treated by corona treatment by corona discharge equipment because some leathers, such as artificial leathers; have chemically inert and nonporous surfaces leading to a low surface energy. Also some leathers also have issues with shrinkage which is avoided by the present invention by a good overall coupling of the leather on the vacuum-belt. This is a very high advantage for a leather inkjet printing device.

Artificial leather is a fabric intended to substitute leather in fields such as upholstery, clothing, and fabrics, and other uses where a leather-like finish is required but the actual material is cost-prohibitive, unsuitable, or unusable for ethical reasons.

Artificial leather is marketed under many names, including "leatherette", "faux leather", and "pleather". Suitable artificial leather includes poromeric imitation leather, corfam, koskin and leatherette. Suitable commercial brands include Biothane™ from BioThane Coated Webbing, Birkibuc™ and Birko-Flor™ from Birkenstock, Kydex™ from Kleerdex, Lorica™ from Lorica Sud, and Fabrikoid™ from DuPont.

The print-receiver (300) is preferable natural leather which is genuine leather and thus not imitation which have been made to resemble genuine leather. The great bulk of these imitations are rubber or plastic-coated fabrics. Natural Leather is an animal skin which has been preserved and dressed for use. Leather is an edge-curl-sensitive print-receiver and rough back-side print-receiver.

The natural leather as print-receiver (300) is preferably a hide leather coming of several animals; preferably selected from the group comprising: cow; goat; horse; alligator; kangaroo, snake; crocodile; sheep or calf.

In the state-of-the-art natural leather; as print-receiver; are taped at the edges of leather to prevent the loss of vacuum power and to hold down the leather in the printing device. But this asks a lot of mounting time which is economically not beneficial.

Applications of these leathers include upholstery, clothing, shoes and the like. In a preferred embodiment the present invention is comprised in the manufacturing of one of these applications.

Corrugated Fibreboard Inkjet Printing Device

Preferably the inkjet printing device (100) is a corrugated fibreboard inkjet printing device, performing a corrugated fibreboard inkjet printing method. The print-receiver (300) of such inkjet printing device (100) is always corrugated fibreboard. Corrugated fibreboard is a paper-based material consisting of a fluted corrugated medium and one or two flat linerboards. The corrugated medium and linerboard board are preferably made of kraft containerboard and/or preferably corrugated fibreboard is between 3 mm and 15 mm thick. Corrugated fibreboard is sometimes called corrugated cardboard; although cardboard might be any heavy paper-pulp based board.

The handling of such print-receivers on a vacuum-belt (400) is difficult due to uncontrolled adhering of the print-receiver (300) against the vacuum-belt. Differences of humidity in bottom and top layer of the print-receiver (300) may cause a curvature effect on the print-receiver (300) which cannot be hold down on current vacuum-belts so the print-receiver (300) may crash against a printhead (200) from the inkjet printing device (100). If no extra guiding means are implemented in the inkjet printing device (100) to hold down the corrugated fibreboard which introduces an extra manufacturing cost. For example in a hot printing area and/or hot curing area, if available, the differences of humidity in bottom and top layer of the corrugated fibreboard can be become bigger. But in the present invention the connection, the hold-down, of the print-receiver (300) with the vacuum-belt (400) is guaranteed even in these hot printing area and/or curing area, if available, from the inkjet printing device (100).

Plastic Foil Inkjet Printing Device

Preferably the inkjet printing device (100) is a plastic foil inkjet printing device, performing a plastic foil inkjet printing method. The print-receiver (300) of such inkjet printing device (100) is always plastic foil, such as polyvinyl chloride (PVC), polyethylene (PE), low density polyethylene (LDPE), polyvinylidene chloride (PVdC). The thickness of a plastic foil is preferably between 30 and 200 μm, more preferably between 50 and 100 μm and most preferably between 60 to 80 μm. In a preferred embodiment the plastic foil is suitable for making plastic bags.

The handling of such print-receivers on a vacuum-belt (400) is difficult due to uncontrolled adhering of the print-receiver (300) against the vacuum-belt (400) due to easy crinkle of the print-receiver (300) while transporting and/or heat upon the surface of the plastic foil, for example in a hot print zone and/or hot curing zone This crinkle effect on the print-receiver (300) cannot be hold down and hold flat on current vacuum-belts so the print-receiver (300) may touch against a printhead (200) from the inkjet printing device (100). Also crinkled plastic foil is not acceptable for sale for example by bad print quality if the plastic foil was not flat while printed. If no extra guiding means are implemented in the inkjet printing device (100) to hold down and flat the plastic foil which introduces an extra manufacturing cost. For example in a hot printing area and/or hot curing area, if available, the crinkle effect of the plastic foil can be become bigger. But in the present invention the connection, the hold-down and flat-down, of the print-receiver (300) with the vacuum-belt (400) is guaranteed even in these hot printing area and/or curing area, if available, from the inkjet printing device (100). The plastic foil is preferably pretreated by corona treatment by corona discharge equipment because most plastics, such as polyethylene and polypropylene, have chemically inert and nonporous surfaces leading to a low surface energy.

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed print-receivers, but also to primed print-receivers.

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, print-receiver (300) fibers, ink, ink residues and/or ink debris such as cured ink, to contaminate via the set of air-channels of the printing table and/or the set of vacuum-belt-air-channels from the conveyor belt the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

The vacuum setting in the vacuum chamber in the present invention is preferably selected between −20 mbar and −80 mbar, more preferably −30 mbar and −60 mbar to have a workable inkjet printing device (100) with an economically manufacturing price, such as less powerful vacuum pump, which can handle also difficult print-receivers such as crease-sensitive print-receiver; heat-sensitive print-receiver; brittle print-receiver; edge-curl sensitive print-receiver and rough back-side print-receiver, even if these print-receivers has a fold or a ruff.

Vacuum-Table (500)

To avoid registration problems while printing on a print-receiver (300) and to avoid collisions while conveying a print-receiver, the print-receiver (300) needs to be connected to a printing table. A vacuum-table (500) is a printing table wherein the print-receiver (300) is connected to the printing table by vacuum pressure. A vacuum-table (500) is also called a porous printing table. Between the print-receiver (300) and the vacuum-table (500) may be a vacuum-belt (400) when a vacuum-belt (400) is wrapped around the vacuum-table (500).

Preferably the vacuum-table (500) in the embodiment comprises a set of air-channels to provide a pressure differential by a vacuum chamber at the support layer of the vacuum-table (500) to create a vacuum-zone and at the bottom-surface of the printing table a set of apertures which are connected to the set of air-channels. These apertures at the bottom layer may be circular, elliptical, square, rectangular shaped and/or grooves, such as slits, parallel with the bottom layer of the vacuum-table (500).

The width or height of the vacuum-table (500) is preferably from 1.0 m until 10 m. The larger the width and/or height, the larger the print-receiver (300) may be supported by the vacuum-table (500) which is an economical benefit.

An aperture at the bottom-surface and at the support surface of the vacuum-table (500) may be connected to one or more air-channels. An aperture at the bottom-surface or support surface of the vacuum-table (500) may be small in size, preferably from 0.3 to 12 mm in diameter, more preferably from 0.4 to 8 mm in diameter, most preferably from 0.5 to 5 mm in diameter and preferably spaced evenly apart on the vacuum-belt (400) preferably 1 mm to 50 mm apart, more preferably from 4 to 30 mm apart and most preferably from 5 to 15 mm apart to enable the creation of uniform vacuum pressure that connects a print-receiver (300) together with the vacuum-table (500).

A set of apertures at the support layer of the vacuum-table (500) may be connected to the air-channels. These apertures at the support layer may be circular, elliptical, square, rectangular shaped and/or grooves, such as slits, parallel with the support layer of the vacuum-table (500). Preferably, if the apertures are grooves, the grooves are oriented along the printing direction of the inkjet printing device (100). Such grooves are also called air-grooves (530). The printing direction of the inkjet printing device (100) is also the same as the conveying direction of the vacuum-belt.

In a preferred embodiment the vacuum-table (500) comprises a plurality of fixed plates at the support-side which each comprises a thermoplastic polymer resin or are made of thermoplastic polymer. To manufacture such a large area of the support layer on the vacuum-table (500) from the present invention, it is much easier to fix multiple smaller plates than handling one big plate to cover the whole base unit of the vacuum-table (500) to form such a large area. Also the bending of one big plate is more difficult to control than a plurality of plates when it is fixed on top of the base unit. One extruded big plate to form a support layer larger than 1.5 $m^2$ is a challenge so multiple smaller plates, which are easier to extrude, is an advantage in this preferred embodiment.

It is an advantage if the fixed plate has a high chemical resistance, high UV (ultra-violet) resistance, high thermal shock resistance, high mechanical resistance, easy machinable (for milling/grinding), low liquid absorbance, high electrical and/or high impact resistant properties which is achievable when the plate comprises a thermoplastic polymer, such as engineering plastic compositions and in a preferred embodiment polyethylene terephthalate (PET), polyamide (PA), high-density polyethylene (HDPE), polytetrafluoroethylene (PTFE), polyoxymethylene (POM) and/or Polyaryletherketone (PAEK), whereof polyethylene terephthalate (PET) is most preferred, due its wear resistance, wet or dry, chemical resistance, and medium cost range. PET also remains stiffer at higher temperatures than plates comprising other thermoplastic polymer resins. The high resistance properties for a support layer are an advantage because the support layer is support to ink spilling, weight of ink receivers, temperature changing's, and/or UV light. The plate may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

In a preferred embodiment the material of the fixed plate is chosen to have a high chemical resistance, high UV (ultra-violet) resistance, high thermal shock resistance, high mechanical resistance, low liquid absorbance, high electrical and/or high impact resistant properties. The plate of the present invention comprises or is preferably an engineering plastic composition (http://en.wikipedia.org/wiki/Engineering_plastic).

In a preferred embodiment the fixed plate comprises a semi-crystalline thermoplastic or is a semi-crystalline thermoplastic composition. Due to the crystalline areas, the plate is extremely tough (strong intermolecular forces) and is capable of withstanding mechanical loads also above the glass transition temperature.

In a preferred embodiment the fixed plate is polyethylene terephthalate (PET) composition, polyamide (PA) composition, high-density polyethylene (HDPE) composition, polytetrafluoroethylene (PTFE) composition, polyoxymethylene (POM) composition or Polyaryletherketone (PAEK) composition, whereof polyethylene terephthalate (PET) composition is most preferred, due its wear resistance, wet or dry, chemical resistance and medium cost range. More preferably the pluralities of such fixed plates, after attaching to the vacuum-table (500), are abraded to have a flatness below 300 μm.

The material of the fixed plate has to be chosen to have a low friction with the backside of ink receivers or porous conveyor belt when wrapped around the inkjet flatbed table. In a preferred embodiment therefore the plate comprises Teflon.

Preferably the vacuum-table (500) of the embodiment comprising a honeycomb structure plate which is sandwiched between a top and bottom sandwich plate which comprises each a set of apertures connect to one or more air-channels in the vacuum-table (500). The honeycomb cores, as part of the air-channels, in the honeycomb structure plate results in a better uniform vacuum distribution on the support surface of the vacuum-table (500).

The dimensions and the amount of air-channels should be sized and frequently positioned to provide sufficient vacuum pressure to the vacuum-table (500). Also the dimensions and the amount of apertures at the bottom-surface of the vacuum-table (500) should be sized and frequently positioned to provide sufficient vacuum pressure to the vacuum-table (500). The dimension between two air-channels or two apertures at the bottom-surface of the vacuum-table (500) may be different. A honeycomb core is preferably sinusoidal or hexagonal shaped.

If a honeycomb structure plate is comprised in the vacuum-table (500) also the dimensions and the amount of honeycomb cores should be sized and frequently positioned to provide sufficient vacuum pressure to the vacuum-table (500). The dimensions between two neighbour honeycomb cores may be different.

The support layer of the printing table should be constructed to prevent damaging of a print-receiver (300) or vacuum-belt (400) if applicable. For example the apertures at the support layer that are connected with the air-channels may have rounded edges. The support layer of the printing table may be configured to have low frictional specifications.

The vacuum-table (500) is preferably parallel to the ground whereon the inkjet printing system is connected to avoid misaligned printed patterns.

The vacuum pressure in a vacuum-zone on the support surface of the vacuum-table (500) may couple the print-receiver (300) and the vacuum-table (500) by sandwiching the vacuum-belt (400) that carries the print-receiver. The coupling is preferably done while printing to hold down the print-receiver (300) to avoid bad alignment and color-on-color register problems. The vacuum pressure in a vacuum-zone on the support surface of the vacuum-table (500) may apply sufficient normal force to the vacuum-belt (400) when the vacuum-belt (400) is moving and carrying a print-receiver (300) in the conveying direction. The vacuum pressure may also prevent any fluttering and/or vibrating of the vacuum-belt (400) or print-receiver (300) on the vacuum-belt. The vacuum pressure in a vacuum-zone may be adapted while printing.

The top-surface of the vacuum-table (500) or a portion of the vacuum-table (500), such as the inner side of its air-channels may be coated to have easy cleaning performances e.g. as result of dust or ink leaks. The coating is preferably a dust repellent and/or ink repellent and/or hydrophobic coating. Preferably the top-surface of the vacuum-table (500) or a portion of the vacuum-table (500), such as the inner side of its air-channels, is treated with an ink repelling hydrophobic method by creating a lubricious and repelling surface which reduces friction.

Vacuum-Belt-Air-Channel

A vacuum-belt-air-channel is an air-channel from the top-surface to the bottom-surface of the conveyor belt. It is also called a suction-hole if the perimeter of the vacuum-belt-air-channel at the top-surface is substantially circular.

The area of a vacuum-belt-air-channel at the top-surface of the vacuum-belt (400) is in the present invention preferably between 0.3 mm2 and 5 mm2. More preferably the perimeter of the vacuum-belt-air-channel at the top-surface has the same shape as a circle, ellipse, oval, rectangle, triangle, square, rectangle, pentagon, hexagon, heptagon, octagon or any polygon containing at least three sides.

The vacuum-belt-air-channel is preferably tapered in the direction of the bottom-surface for optimal vacuum pressure effect at the top-surface.

The perimeter of a suction-hole is preferably from 0.3 to 10 mm in diameter, more preferably from 0.4 to 5 mm in diameter, most preferably from 0.5 to 2 mm in diameter The vacuum-belt-air-channels in the air-sucking-zone, also called vacuum-zone are preferably spaced evenly apart on the vacuum-belt (400) preferably 3 mm to 50 mm apart, more preferably from 4 to 30 mm apart and most preferably from 5 to 15 mm apart to enable the creation of uniform vacuum pressure that holds the print-receiver (300) together with the vacuum-belt. Smaller the apertures in the vacuum-belt, higher the vacuum pressure at the top of the vacuum-belt.

Vacuum-belt-air-channel is preferably drilled, perforated or cut in the conveyor belt but also a laser may form a vacuum-belt-air-channel in a conveyor belt.

Vacuum-Belt (400)

Preferably the vacuum-belt (400) has two or more layers of materials wherein an under layer provides linear strength and shape, also called the carcass and an upper layer called the cover or the support-side. The carcass is preferably a woven fabric web or knitted fabric web and more preferably a woven/knitted fabric web comprising polyester, nylon, glass fabric or cotton. The material of the cover comprises preferably various rubber and more preferably plastic compounds and most preferably thermoplastic polymer resins. But also other exotic materials for the cover can be used such as silicone or gum rubber when traction is essential. An example of a multi-layered conveyor belt for a general belt conveyor system wherein the cover having a gel coating is disclosed in US 20090098385 A1 (FORBO SIEBLING GMBH).

Preferably the vacuum-belt (400) comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC) and/or Polyphenylene sulphide (PPS).

Preferably the vacuum-belt (400) is and endless vacuum-belt. Examples and figures for manufacturing an endless multi-layered vacuum-belt (400) for a general belt conveyor system are disclosed in EP 1669635 B (FORBO SIEBLING GMBH).

The top-surface of the vacuum-belt (400) or a portion of the vacuum-belt, such as its air-channels, may be coated to have easy cleaning as result of e.g. dust or ink leaks. The coating is preferably a dust repellent and/or ink repellent and/or hydrophobic coating. Preferably the top-surface of the vacuum-belt (400) or a portion of the vacuum, belt is treated with an ink repelling hydrophobic method by creating a lubricious and repelling surface which reduces friction.

Preferably the top-surface of the vacuum-belt (400) is flat where no air apertures are. The flatness is preferably below 500 μm and more preferably below 400 μm, most preferably between 0 and 250 μm. The average roughness (Ra) of the top-surface of the vacuum belt (400), where no air apertures are, is preferably lower than 200 μm and more preferably below 150 μm, most preferably between 0 and 100 μm. A rough top-surface has some difficulties for cleaning the vacuum-belt (400) when it is spoiled with ink residues. It is seen that dried ink on such roughed support-side of a vacuum belt by rotation around the drums gives flakes, cracks of dried ink which contaminates wet ink layers and/or creates dust in an industrial environment and/or gives nozzle failures in a printhead.

A layer of neutral fibres in the vacuum-belt (400) is preferably constructed at a distance from the bottom surface between 2 mm and 0.1 mm, more preferably between 1 mm and 0.3 mm. This layer with neutral fibres is of big importance to have a straight conveying direction with minimal side force on the vacuum-belt (400) and/or minimized fluctuation of the Pitch Line of the vacuum-belt (400) for high printing precision transportation.

The top surface of the vacuum-belt (400) (thus the cover whereon the print-receivers is carried) comprises preferable hard urethane with a preferred thickness (measured from top surface to bottom surface) between 0.2 to 2.5 mm. The total thickness (measured from top surface to bottom surface) of the vacuum-belt (400) is preferably between 1.2 to 7 mm. The top-surface is preferably high resistance to solvents so the inkjet printing device (100) is useful in an industrial printing and/or manufacturing environment. This makes the vacuum-belt (400) strong to carry heavy print-receivers but also have a strong tear strength (between 100 and 300 N/mm); a high maximum operational temperature (between 50 and 90° C.); a shore hardness of the top surface between 80 and 120 Shore A); a light weight (for easy manufacturing the inkjet printing device (100)) between 1.8 and 4 kg/m2.

Printhead (200)

A printhead (200) is a means for jetting a liquid on a print-receiver (300) through a nozzle. The nozzle may be comprised in a nozzle plate which is attached to the printhead. A printhead (200) preferably has a plurality of nozzles which may be comprised in a nowwle plate. A set of liquid channels, comprised in the printhead, corresponds to a nozzle of the printhead (200) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a printhead (200) is also called a jettable liquid. A high viscosity jetting method with UV curable inkjet ink is called a high viscosity UV curable jetting method. A high viscosity jetting method with water based inkjet ink is called a high viscosity water base jetting method.

The way to incorporate printheads into an inkjet printing device (100) is well-known to the skilled person.

A printhead (200) may be any type of inkjet head such as a Valvejet printhead, piezoelectric inkjet printhead, thermal inkjet printhead, a continuous inkjet printhead type, electrostatic drop on demand inkjet printhead type or acoustic drop on demand inkjet printhead type or a page-wide inkjet printhead array, also called a page-wide inkjet array.

A printhead (200) comprises a set of master inlets to provide the printhead (200) with a liquid from a set of external liquid feeding units. Preferably the printhead (200) comprises a set of master outlets to perform a recirculation of the liquid through the printhead. The recirculation may be done before the droplet forming means but it is more preferred that the recirculation is done in the printhead (200) itself, so called through-flow printheads. The continuous flow of the liquid in a through-flow printheads removes air bubbles and agglomerated particles from the liquid channels of the printhead, thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow printhead is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the printhead (200) wherein the mixing means is attached to the set of master inlets and the set of liquid channels. The mixing means may comprise a stirring device in a liquid container, such as a manifold in the printhead, wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the printhead (200). The droplet forming means are activating the liquid channels to move the liquid out the printhead (200) through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The printhead (200) of the present invention is preferably suitable for jetting a liquid having a jetting viscosity of 8 mPa·s to 3000 mPa·s. A preferred printhead (200) is suitable for jetting a liquid having a jetting viscosity of 20 mPa·s to 200 mPa·s; and more preferably suitable for jetting a liquid having a jetting viscosity of 50 mPa·s to 150 mPa·s.

Belt Step Conveyor System

The embodiment of the inkjet printing device (100) comprises a vacuum-belt, wrapped around the vacuum-table (500), wherein the vacuum-belt (400) carries a print-receiver (300) by moving from a start location to an end location in preferably successive distance movements also called discrete step increments. This is also called a belt step conveyor system.

The belt step conveyor system may be driven by an electric stepper motor to produce a torque to a pulley so by friction of the vacuum-belt (400) on the powered pulley the vacuum-belt (400) and the print-receiver (300) is moved in a conveying direction. The use of an electric stepper motor makes the transport of a load more controllable e.g. to change the speed of conveying and move the load on the vacuum-belt (400) in successive distance movements. An example of a belt step conveying belt system with an electric stepper motor is described for the media transport of a wide-format printer in EP 1235690 A (ENCAD INC).

To know the distance of the successive distance movements in a belt step conveyor system, that is driven by an electric stepper motor to produce a torque to a pulley so by friction of the vacuum-belt (400) on the powered pulley the vacuum-belt (400) and the print-receiver (300) is moved in a conveying direction substrate on the vacuum-belt, so it can be communicated to other controllers such as a renderer of the inkjet printing device (100) or the controllers of a (inkjet) printhead, an encoder is comprised on one of the pulleys that are linked with the vacuum-belt.

Piezoelectric Inkjet Printheads

Another preferred printhead (200) for the present invention is a piezoelectric inkjet printhead. Piezoelectric inkjet printhead, also called piezoelectric inkjet printhead, is based on the movement of a piezoelectric ceramic transducer, comprised in the printhead, when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric inkjet printhead controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial piezoelectric inkjet printheads are TOSHIBA TEC™ CK1 and CK1L from TOSHIBA TEC™ (https://www.toshibatec.co.jp/en/products/industrial/inkjet/prod ucts/cf1/) and XAAR™ 1002 from XAAR™ (http://www.xaar.com/en/products/xaar-1002).

A liquid channel in a piezoelectric inkjet printhead is also called a pressure chamber.

Between a liquid channel and a master inlet of the piezoelectric inkjet printheads, there is a manifold connected to store the liquid to supply to the set of liquid channels.

The piezoelectric inkjet printhead is preferably a through-flow piezoelectric inkjet printhead. In a preferred embodiment the recirculation of the liquid in a through-flow piezoelectric inkjet printhead flows between a set of liquid channels and the inlet of the nozzle wherein the set of liquid channels corresponds to the nozzle.

In a preferred embodiment in a piezoelectric inkjet printhead the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes.

In a preferred embodiment the piezoelectric inkjet printhead has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric inkjet printhead has a native print resolution from 25 DPI to 2400 DPI, in a more preferred embodiment the piezoelectric inkjet printhead has a native print resolution from 50 DPI to 2400 DPI and in a most preferred embodiment the piezoelectric inkjet printhead has a native print resolution from 150 DPI to 3600 DPI.

In a preferred embodiment with the piezoelectric inkjet printhead the jetting viscosity is from 8 mPa·s to 200 mPa·s more preferably from 25 mPa·s to 100 mPa·s and most preferably from 30 mPa·s to 70 mPa·s.

In a preferred embodiment with the piezoelectric inkjet printhead the jetting temperature is from 10° C. to 100° C. more preferably from 20° C. to 60° C. and most preferably from 30° C. to 50° C.

The nozzle spacing distance of the nozzle row in a piezoelectric inkjet printhead is preferably from 10 μm to 200 μm; more preferably from 10 μm to 85 μm; and most preferably from 10 μm to 45 μm.

Inkjet Ink

In a preferred embodiment, the liquid in the printhead (200) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s-1 or with the HAAKE Rotovisco 1 Rheometer with sensor C60/1 Ti at a shear rate of 1000s-1.

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the printhead (200) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

REFERENCE SIGNS LIST

TABLE 1

| | | | |
|---|---|---|---|
| 100 | inkjet printing device | 200 | printhead |
| 300 | print-receiver | 350 | pattern |
| 400 | vacuum-belt | 530 | air-groove |
| 410 | pulley | 428 | vacuum-belt-air-channels |
| 500 | vacuum-table | 425 | second vacuum-zone |
| 418 | first column of vacuum-belt-air-channels | 435 | third vacuum-zone |
| 428 | second column of vacuum- | 420 | rough layer |

TABLE 1-continued

| | | | |
|---|---|---|---|
| | belt-air-channels | | |
| 438 | third column of vacuum-belt-air-channels | 520 | rough layer |
| 415 | first vacuum-zone | 550 | flat area |

The invention claimed is:

1. An inkjet printing device comprising:

a vacuum table; and a vacuum belt wrapped around the vacuum table in a conveying direction, the vacuum table including a flat area located between a first air groove and a second air groove; wherein the first air groove is aligned in the conveying direction;

the second air groove is aligned in the conveying direction;

the vacuum belt includes:

a first column of vacuum belt air channels extending in the conveying direction and connected to the first air groove;

a second column of vacuum belt air channels extending in the conveying direction and connected to the second air groove; and a third column of vacuum belt air channels extending in the conveying direction and connected to the flat area via a plurality of air channels provided in a rough layer on a back side of the vacuum belt and/or a rough layer in the flat area of the vacuum table; and the rough layer on the back side of the vacuum belt and/or the rough layer in the flat area of the vacuum table has an average roughness $R_a$ larger than 15 μm.

2. The inkjet printing device according to claim 1, wherein a support side of the vacuum belt includes:

a first vacuum zone connected to the first column of vacuum belt air channels;

a second vacuum zone connected to the second column of vacuum belt air channels;

a third vacuum zone connected to the third column of vacuum belt air channels;

a first non-vacuum zone located between the first vacuum zone and the third vacuum zone; and a second non-vacuum zone located between the second vacuum zone and the third vacuum zone; wherein a width of the first non-vacuum zone is larger than half of a width of the first vacuum zone, and larger than half of a width of the first air groove; and a width of the second non-vacuum zone is larger than half of a width of the second vacuum zone, and larger than half of a width of the second air groove.

3. The inkjet printing device according to claim 2, wherein each of the vacuum belt air channels has a minimum cross-sectional area, a size of which defines a minimum profile area of the vacuum belt air channel;

a total sum of the minimum profile area of the vacuum belt air channels in the third vacuum zone is at minimum 5 times greater than a total sum of the minimum profile area of the vacuum belt air channels in the first vacuum zone; and the total sum of the minimum profile area of the vacuum belt air channels in the third vacuum zone is at minimum 5 times greater than a total sum of the minimum profile area of the vacuum belt air channels in the second vacuum zone.

4. The inkjet printing device according to claim 3, wherein the rough layer located at the back side of the vacuum belt is a woven fabric or a knitted fabric.

5. The inkjet printing device according to claim 4, wherein the woven fabric is selected from the group consisting of a plain-weave fabric, a twill-weave fabric, and a satin-weave fabric; and the support side of the vacuum belt includes a thermoplastic polymer resin.

6. A method of using the inkjet printing device according to claim 1 comprising the step of:

printing on genuine leather or hide leather with the inkjet printing device.

7. An inkjet printing method comprising the steps of:

providing the inkjet printing device according to claim 1 with a printhead; and conveying a print receiver on the vacuum belt underneath the printhead.

8. The inkjet printing method according to claim 7, where the print receiver is selected from the group consisting of a heat-sensitive print receiver, a rigid multilayered print receiver, an edge curl-sensitive print receiver, genuine leather, hide leather, corrugated fibreboard, a plastic foil, and a printing plate.

9. The inkjet printing method according to claim 8, wherein the average roughness $R_a$ of the rough layer on the back side of the vacuum belt and/or the rough layer in the flat area of the vacuum table is between 17 μm and 500 μm.

10. The inkjet printing method according to claim 9, wherein a support side of the vacuum belt includes:

a first vacuum zone connected to the first column of vacuum belt air channels;

a second vacuum zone connected to the second column of vacuum belt air channels;

a third vacuum zone connected to the third column of vacuum belt air channels;

a first non-vacuum zone located between the first vacuum zone and the third vacuum zone; and a second non-vacuum zone located between the second vacuum zone and the third vacuum zone; wherein a width of the first non-vacuum zone is larger than half of a width of the first vacuum zone, and larger than half of a width of the first air groove; and a width of the second non-vacuum zone is larger than half of a width of the second vacuum zone, and larger than half of a width of the second air groove.

11. The inkjet printing method according to claim 10, wherein each of the vacuum belt air channels has a minimum cross-sectional area, a size of which defines a minimum profile area of the vacuum belt air channel;

a total sum of the minimum profile area of the vacuum belt air channels in the third vacuum zone is at minimum 5 times greater than a total sum of the minimum profile area of the vacuum belt air channels in the first vacuum zone; and the total sum of the minimum profile area of the vacuum belt air channels in the third vacuum zone is at minimum 5 times greater than a total sum of the minimum profile area of the vacuum belt air channels in the second vacuum zone.

12. The inkjet printing method according to claim 11, wherein the rough layer located at the back side of the vacuum belt is a woven fabric or a knitted fabric.

13. The inkjet printing method according to claim 12, wherein the woven fabric is selected from the group consisting of a plain-weave fabric, a basked-weave fabric, a twill-weave fabric, and a satin-weave fabric.

14. The inkjet printing method according to claim 12, wherein the knitted fabric is a weft-knitted fabric or a warp-knitted fabric.

15. An inkjet printing method comprising the steps of:

providing the inkjet printing device according to claim 2 with a printhead; and conveying a print receiver on the vacuum belt underneath the printhead.

16. The inkjet printing device according to claim 1, wherein the third column of vacuum belt air channels includes vacuum belt air channels arranged in a lattice pattern or a blue-noise-pseudo-random pattern.

17. The inkjet printing device according to claim 1, wherein the first, second, and/or third column of vacuum belt air channels include vacuum belt air channels having an area at a top surface of the vacuum belt between 0.3 $mm^2$ and 5 $mm^2$.

18. The inkjet printing device according to claim 1, wherein the first, second, and/or third column of vacuum belt air channels include vacuum belt air channels having a perimeter at a top surface of the vacuum belt in a shape of a circle, ellipse, oval, rectangle, triangle, square, rectangle, pentagon, hexagon, heptagon, or an octagon.

19. The inkjet printing device according to claim 1, wherein the first, second, and/or third column of vacuum belt air channels include vacuum belt air channels that are tapered in a direction of a bottom surface of the vacuum belt.

* * * * *